US005497821A

United States Patent [19]

Arvedi et al.

[11] Patent Number: 5,497,821

[45] Date of Patent: Mar. 12, 1996

[54] MANUFACTURE OF BILLETS AND BLOOMS FROM A CONTINUOUSLY CAST STEEL

[75] Inventors: Giovanni Arvedi, Via Mercatello, 26; Giovanni Gosio, both of Cremona, Italy

[73] Assignee: Giovanni Arvedi, Cremona, Italy

[21] Appl. No.: 199,137

[22] PCT Filed: Sep. 14, 1992

[86] PCT No.: PCT/It92/00113

§ 371 Date: Feb. 25, 1994

§ 102(e) Date: Feb. 25, 1994

[87] PCT Pub. No.: WO93/04802

PCT Pub. Date: Mar. 18, 1993

[30] Foreign Application Priority Data

Sep. 12, 1991 [IT] Italy ..... MI91A2414

[51] Int. Cl.[6] ..... B22D 11/04; B22D 11/12

[52] U.S. Cl. ..... 164/476; 164/417; 164/424

[58] Field of Search ..... 164/476, 477, 164/417, 424

[56] References Cited

U.S. PATENT DOCUMENTS

| | | | |
|---|---|---|---|
| 3,393,727 | 7/1968 | Rys | 164/424 |
| 3,478,809 | 11/1969 | Tarmann et al. . | |
| 3,638,713 | 2/1972 | Knell et al. . | |
| 4,493,363 | 1/1985 | Fredriksson et al. | 164/476 |

FOREIGN PATENT DOCUMENTS

| | | | |
|---|---|---|---|
| 0391824 | 10/1990 | European Pat. Off. . | |
| 57-58964 | 4/1982 | Japan | 164/417 |
| 60-15058 | 1/1985 | Japan | 164/476 |
| 61-202751 | 9/1986 | Japan | 164/476 |
| 62-252647 | 11/1987 | Japan | 164/476 |
| 63-215353 | 9/1988 | Japan | 164/476 |
| 63-278654 | 11/1988 | Japan | 164/476 |
| WO89/12517 | 12/1989 | WIPO . | |

OTHER PUBLICATIONS

Abstract of Japanese Patent Publication 63–171255 Published Jul. 15, 1988.

*Primary Examiner*—J. Reed Batten, Jr.

*Attorney, Agent, or Firm*—Panitch Schwarze Jacobs & Nadel

[57] ABSTRACT

Steel is continuously cast by employing a mold and a casting track. The casting track has a metallurgical length wherein the steel is substantially liquidus at one end of the length and substantially solidified at the other end of the length. At a distance along the length, the area of the cross-section of the solidifying liquid steel is reduced while maintaining the length of the perimeter of the reduced cross-section. The distance is between about 10% and about 80% of the length from the one end to the other end.

4 Claims, 1 Drawing Sheet

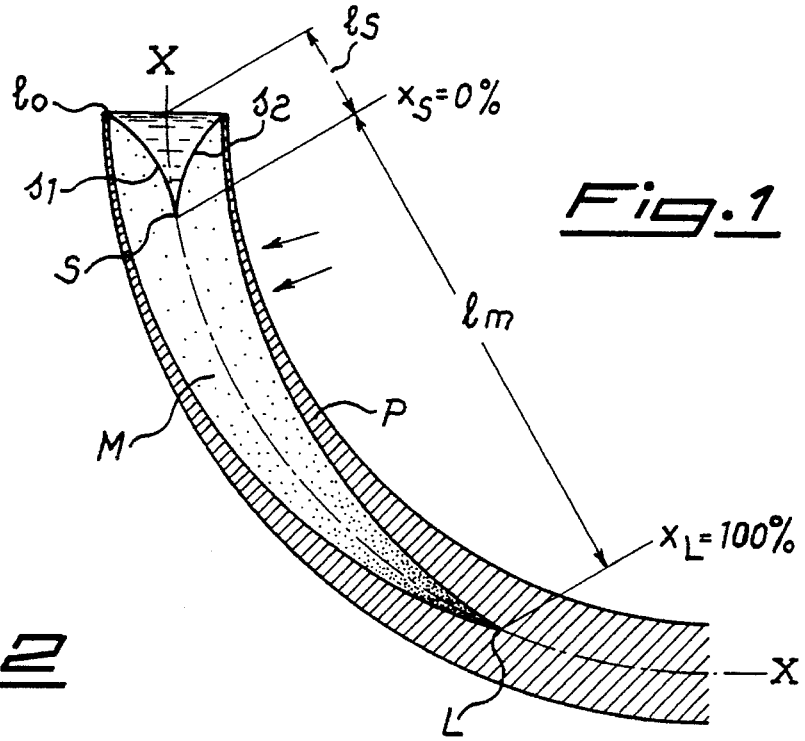
Fig. 1
Fig. 2
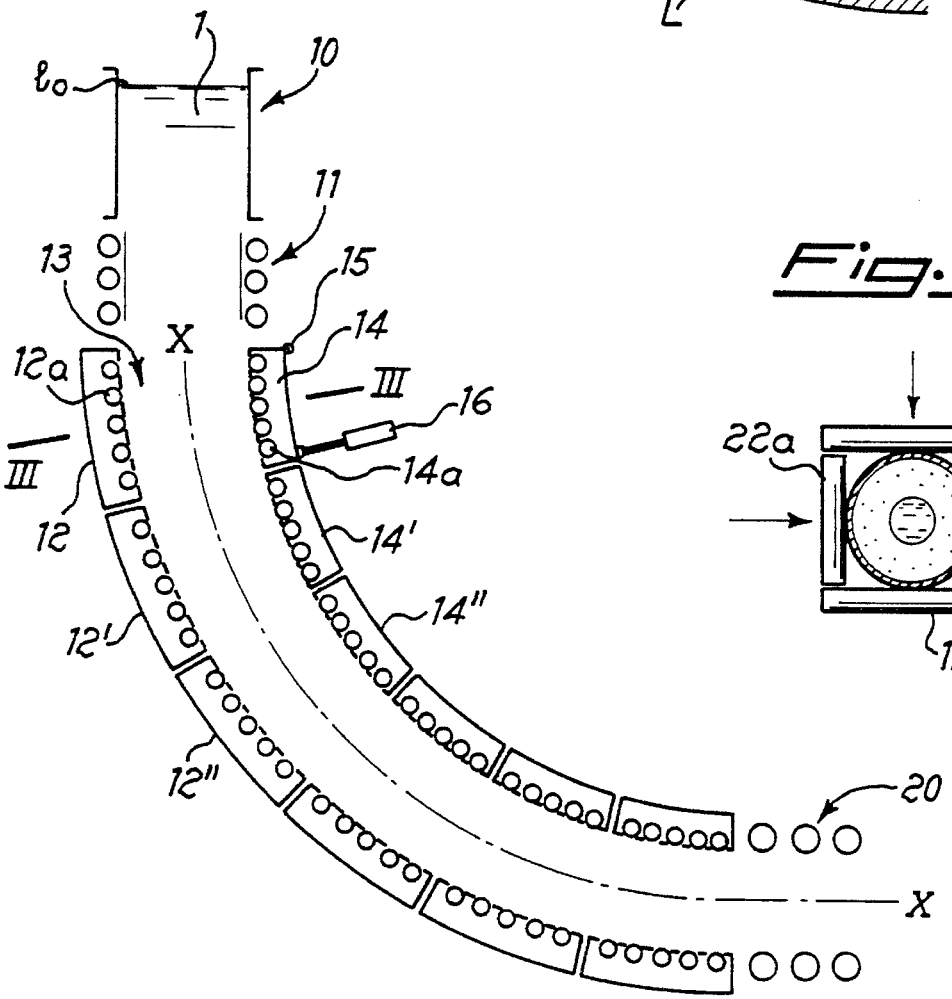
Fig. 3
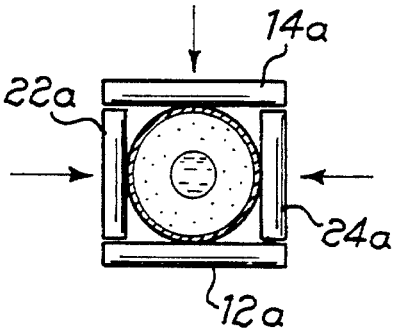

MANUFACTURE OF BILLETS AND BLOOMS FROM A CONTINUOUSLY CAST STEEL

The present invention relates to a process for the direct manufacture of billets and blooms from a continuously cast steel showing high or excellent quality, as well as an apparatus for the realization of such process.

It is known that the continuous casting is ever more utilized for the manufacture of steel, because of the clear and well known advantages therein involved, with respect to other kinds of casting. It is clear however that the thus obtained product, as it appears at the extracting machine at the end of the curvilinear casting route, shows the features of a typical casting piece, with all the qualitative drawbacks typical of these semifinished products. It is in fact possible to see, by a metallographic analysis, that the grain size and the structure isotropy are unsatisfactory and that the carbon percentage is not homogeneous but prevailingly concentrated in the central zone of the product, with consequent segregations which make the product, coming from the continuous casting, not directly exploitable for the rolling, when it is desirable to obtain end products consisting of high and excellent quality steel.

In the case of a high quality steel, the continuous casting can be exploited for obtaining blooms, which, after transit through an oven, are conveyed to a size-breaking rolling mill, in order to be converted into billets, which in their turn, optionally heated in a further oven, are eventually conveyed to a finishing rolling mill. In the case of an excellent quality steel, the casting is even occurring in the form of an ingot, and not in a continuous way, and in each ingot the cooling is adjusted by means of a predetermined cycle; therefore, the ingots, or the big size blooms, are conveyed to the size-breaking and subsequently to the pre-rolling or cogging and to the finishing rolling, wherein there are usually provided, between two subsequent operations, intermediate heatings in an oven, thus performing an extremely long and expensive operative cycle.

It is thus a purpose of the instant invention to supply a process allowing the direct manufacture, by means of a continuous casting, of billets or blooms showing such features as to be easily transferred, in a subsequent time and without any further operation, to the finishing rolling. Another object of the instant invention is residing in an apparatus for the realization of said process.

An advantage coming from the process according to the invention, described hereinbelow, is residing in that the consequent inner grain of the casting product is showing those features of fineness, homogeneity and isotropy, as well as of absolute absence of segregations, which are usually observed in a product ready for the finishing rolling, thus omitting the steps concerning size-breaking and pre-rolling, including the respective intermediate heatings, and thus reaching a considerable power saving.

The process according to the instant invention is characterized by a liquid core distortion of the casting product, obtained by means of a continuous casting, which causes a reduction of the product cross-section, the perimeter of the same cross- section being unchanged, in the route between the lowermost geometrical point on the casting axis, where it is still possible to find superheated liquid, and the end point of the metallurgical length, where the product is completely solidified.

According to a preferred embodiment of the instant invention, said distortion is made to occur in a zone where the concentration of the solid grains is from 10 to 80%.

The distortion hereinabove, from a practical point of view, can involve the conversion of the shape from round to square (i.e., billet), round to rectangular (i.e., bloom), billet to bloom, or bloom to a more flattened cross-section.

The apparatus for carrying out the process according to the invention is essentially comprising at least one of the sectors of the roller train along the curvilinear route, which is given the possibility of movement with respect to the opposite sector, and means fit for bringing said mobile sector near the opposite one on at least one plane containing the casting axis.

The purposes, the advantages and the features of the process and of the apparatus according to the instant invention will be clearer from the following detailed description and drawings, which are supplied for illustrating purposes but do not limit in any way the scope of the same invention.

As to the drawings:

FIG. 1 is showing an extremely schematic view of the sole casting product along the curvilinear route, in order to point out the basic parameters of the process according to the invention;

FIG. 2 is showing an equally schematic view of a continuous casting apparatus, modified as to realize the process according to the invention; and FIG. 3 is showing a section view along line III—III of FIG. 2, in the case of the distortion of a rod.

Referring now to FIG. 1, there is represented, in an extremely schematic way and in a section containing the casting axis X—X, a product made from steel during a continuous casting. By $l_o$ there is indicated the free surface of the liquid in the ingot mold and by S the lowermost geometrical point, on the casting axis, where it is still possible to find superheated liquid. In other words, below S the temperature reaches the "liquidus" value, typical of each peculiar steel, whereas above the two lines $s_1$ and $s_2$ the temperature value is higher and the liquid, in such zone, is superheated and void of solid grains.

The position of point S can be determined, for each casting mill, depending on the temperature value of the steel contained in the mold above the "liquidus" value, according to the kind of the steel, and can be expressed by means of time terms (t), corresponding to a certain speed. From the determination of the time t it is possible to extrapolate the position of S depending on the different possible casting velocities.

It is usually supposed that point S be lying below the mold, and precisely in the first leg of the roller train, commonly defined "segment zero" or extractable section. L is representing the point where the casting product is completely solidified and the distance $l_m$, observed between such point and point S, is commonly defined "metallurgical length".

It is believed that the liquid lying below the two lines $s_1$ and $s_2$ and comprised between such lines and the inner walls of the already solidified portion P ("skin") be already containing solid grains with a concentration increasing towards the lower zone, until the complete solidification in L. In this viscous or semisolid mass (M) are in fact in equilibrium either the true actual liquid or the solid suspended grains. On the X—X axis, the concentration of the solid grains in the mass (M) is equal to zero in S and to 100% in L, linearly increasing along with the metallurgical length.

The progression speed of the solid portion P is clearly equal in every point, whereas the speed of the mass (M) has to fulfill a different condition, namely to feed the solidification process as to avoid the formation of empty zones before point L, which would involve the presence of cracks in the end product. It has to be furtherly remarked that the metallurgical length $l_m$ has to be such as to allow point L to be upstream of the extraction device 20, lying at the end of the curvilinear casting route (see FIG. 2).

It was now surprisingly found that by compressing according to the invention the walls P of the "liquid core" casting product, namely before point L, thus reducing the volume of the same product by distorting its cross-section, there is obtained a bloom or a billet showing all the desired features hereinabove fit for obtaining a steel product having a high or excellent quality.

The mechanism allowing such a transformation is not completely clear, but it is believed that by bringing the solid walls P near each other, there occurs, inside the fluid mass M, which contains already solidified grains and which can be defined semisolid or "viscous", a speed gradient or acceleration, causing the breaking of the dendritic branchings which tend to form inside the same mass. The thus crushed grains get reduced in their size and are oriented in a way as random (casual) as possible, thus acquiring particular isotropy and homogeneity features, while avoiding segregations, namely increasing concentrations of carbon segregations towards the inner portion of the product.

An essential condition, in order to make such results to occur, is however residing in that the liquid core distortion, carried out between points S and L, be reducing the volume of the casting product, the length being unchanged, whereas its lateral surface is maintained constant; in this case in fact there are neither stretching nor rolling action, in a true actual sense, involving a creep or slippage of solid material, until we are in the presence of a viscous mass M inside the product itself, namely along the whole length $l_m$.

In terms of cross-section (the length in fact doesn't have any impact, as it is kept constant), the area of the cross-section has to be reduced, whereas its perimeter is approximately kept constant.

The following distortions will therefore be possible:

from round product to square product or to rectangular product; or from square billets to rectangular blooms; or, at last from a certain bloom to a more flattened product, namely a product showing a higher ratio between the different sides.

From a theoretical point of view, there would be possible even a distortion involving the conversion of a casting cross-section having n sides to a distorted cross-section having, at the end of the metallurgical length, n-1 sides, even if such hypothesis has poor chances to be reduced to practice.

It has to be underlined that should the distortion occur without the fulfilment of such a condition, the volume would increase or would at the most remain at a constant level; there would therefore fail the presupposition for obtaining the desired features hereinabove, allowing the product to be directly conveyed to the finishing rolling, without any intermediate operative step, as it is already endowed with all the features of the desired semifinished product.

As it was already said, the distortion according to the instant invention can occur all along the metallurgical length, starting from point S, but preferably inside a limited zone thereof; this latter can be defined as the zone corresponding to the 10–80% of the percentage concentration x of solid grains in the mass M, which can be easily determined if we take into account that $x_s=0$ and that $x_L=100$. Therefore if $l_S$ is the distance of S from $l_o$, the $x_l$ concentration in a whatsoever point far l from $l_o$ is:

$$x=\frac{l-l_S}{l_m}.$$

It can be useless in fact to carry out the distortion with volume reduction in a too high zone of the casting, where the concentration of the solid grains is least and the grains themselves couldn't be affected, because of their dispersion in the liquid mass, by the mechanical action exerted by the solidified walls P.

From the other side, it can even be a drawback to perform the distortion in the lowermost zone, in the proximity of point L, where the walls P are already so near as to easily build up a few weldings and consequently a few pockets containing liquid material which, by solidification and consequent volume shrinking, would give rise to cavities inside the product, which drawback has preferably to be avoided.

Referring to FIG. 2, there is represented, in an extremely schematic way, an apparatus fit for carrying out the process according to the invention, as it is shortly described hereinbelow. The product 1, contained in the ingot mold 10, descends, through the so called "foot rolls" 11 along the roller train 13, defined by pairs of opposed sectors of roller cages 12, 14, 12', 14' and so on. The first sector, immediately after the foot rolls 11, where it is believed sufficient, in certain cases, to limit the volume reducing distortion according to the present invention, is usually called "segment zero". Segments 12, 12', 12" and so on are all lying on the outer portion of the curvilinear roller train, namely they have a greater bending radius, whereas segments 14, 14' and so on are defined inner segments. The rolls of segment 12 are represented by the reference number 12*a* and the ones of segment 14 by the reference number 14*a* and so on.

According to the instant invention and to the hypothesis above, according to which the distortion according to the invention is determined by said first segment, the inner portion 14 is made to be mobile with respect to the outer roller train 12 in whatsoever known way, there being provided means 16 for drawing cage 14 near the opposite cage 12, which remains motionless. As it is shown in FIG. 2, the cage or bearing structure 14, comprising rolls 14*a*, is pivoted at 15 at one of its ends, preferably the superior one, and a hydraulic piston 16 pushes the opposite end of the inner structure towards the motionless outer roller train 12. Of course, there can be provided whatsoever other solution of the problems, known to the skilled in the art; it is thus possible, for instance, to let the inner segment 14 slide along a skid device and to provide one or more hydraulic pistons for the thrust along the same skid device. In any case, an apparatus of this kind can be used when a square product or billet has to be converted into a bloom or when an already rectangular product, like a bloom, has to be converted into an always rectangular however more flattened shape, for instance a thick slab.

Should on the contrary a round product be converted, by means of distortion, into a product showing a square or rectangular cross-section, it is no more sufficient to work in the plane of FIG. 2, but a corresponding action has to be contemporaneously carried out in a plane normal to the plane above, always containing the casting axis X—X, as it is recorded on the section view of FIG. 3. In this case the distortion of a round product 1 is contemporaneously caused by two pairs of rolls, lying in diametrically opposed positions of the perimeter of the same round product, namely rolls 12*a* and 14*a* of the opposite outer and inner cages 12 and 14, shown in FIG. 2, as well as rolls 22*a* and 24*a*, respectively belonging to roll cages not shown in FIG. 2, having the opposite rolls oriented normally to the rolls 12*a* and 14*a* of cages 12 and 14.

Preferably the subsequent rolls, downstream of the ones arranged in the sector undergoing distortion, are supplied with pistons fit for exerting a thrust towards the inside of the casting, no more for distortion purposes but for opposing the ferrostatic pressure and the possible consequent swelling, which can occur between the contact with a roll and the subsequent one, thus fitting to the size reached in the preceding distortion phase.

EXAMPLE

From a continuous casting mold, having a round cross-section, it was cast, with a progression speed V=2m/min., a round product having a diameter of 130 mm. In a zone between 28% and 76% of the concentration of the solid grains and by a metallurgical length equal (in this case) to 8 m, there was caused a distortion leading to a substantially square billet having a 100 mm side.

Subsequently the same rod was converted in another billet, having a similar size, however increasing the speed up to 3 m/min., and the distortion, according to the description above, was made to occur in a zone between the concentration values x equal to 14% and 46%, whereas the metallurgical length was 12 m.

In both the cases there were sampled specimens of the cast product, once solidification was over, thus finding, by macrographic analysis, the following results:

a) fine structure, without dendritic evidence;

b) structure isotropy, without any main orientation of the grains;

c) absence of segregations, with homogeneity, in terms of chemical analysis, all along the cross-section;

d) isotropy of the mechanical features (tensile strength, yield point, break elongation, impact strength);

e) better mechanical features, with respect to the product coming from a traditional casting, such as to allow the reaching of the same end features of the end product with lower percentages of reduction in the rolling step.

From the above it is clear that the apparatus according to the instant invention allows the product, coming from the continuous casting and handled according to the process above, to be directly conveyed to a finishing rolling mill, by merely interposing a heating oven, optionally an induction oven, for adjusting the temperature according to the rolling values.

Optional additions and changes can be carried out by the skilled in the art, as to the process according to the instant invention hereinabove, as well as modifications of the described and illustrated apparatus for carrying out such process, without exceeding the scope of the same invention.

We claim:

1. A method for continuously casting steel, the method comprising the steps of:

providing a mold leading to a casting track, the mold having an inlet and the casting track having an outlet;

placing liquid steel in the inlet of the mold, the liquid steel having a temperature above the liquidus temperature value for the steel;

allowing the liquid steel to solidify in the casting track while moving the solidifying liquid steel in a direction toward the outlet of the casting track, the liquid steel solidifying in a predefined manner wherein at a first point along the casting track substantially all of the liquid steel has a liquidus temperature value and a concentration of solid grains of substantially zero percent and wherein at a second point along the casting track all of the liquid steel is substantially solidified and has a concentration of solid grains of substantially 100 percent, the first point being closer to the inlet and the second point being closer to the outlet, the first and second points being generally fixed with respect to the casting track, the length between the first and second points being generally defined by a metallurgical length and each point between the first and second points being a distance from the first point, each point being generally expressible as a percentage, distance×100 / metallurgical length, the solidifying liquid steel at each point along the metalurgical length having a cross-section generally perpendicular to the direction of movement with an area, the cross-section having a perimeter with a length; and reducing the area of the cross-section of the solidifying liquid steel at a region between about the 10% and about the 80% points while maintaining the length of the perimeter of the reduced cross-section.

2. The method of claim 1 wherein the reducing step further comprises distorting the solidifying liquid steel from a round cross-section to a rectangular cross-section.

3. The method of claim 1 wherein the reducing step further comprises distorting the solidifying liquid steel from a generally square cross-section to a rectangular cross-section.

4. The method of claim 1 wherein the reducing step further comprises distorting the solidifying liquid steel from a first rectilinear cross-section having a first width and a first length to a second rectilinear cross-section having a second width smaller than the first width and a second length larger than the first length.

* * * * *